United States Patent [19]

Oki et al.

[11] Patent Number: 4,964,587

[45] Date of Patent: Oct. 23, 1990

[54] COILER

[75] Inventors: Takehiko Oki; Fumio Fukushima; Katsusuke Kawanami, all of Hiroshima, Japan

[73] Assignee: Mitsubishi Jukogyo Kabushiki Kaisha, Tokyo, Japan

[21] Appl. No.: 428,002

[22] Filed: Oct. 27, 1989

Related U.S. Application Data

[63] Continuation of Ser. No. 243,561 filed as PCT JP86/00652 on Dec. 25, 1986 published as WO88/04966 on Jul. 14, 1988, abandoned.

[51] Int. Cl.[5] ..... B21C 47/06

[52] U.S. Cl. ..... 242/78.1; 242/78.3; 72/148

[58] Field of Search ..... 242/67.1 R, 78.1, 78.3, 242/65; 72/21, 146, 148

[56] References Cited

U.S. PATENT DOCUMENTS

| | | | |
|---|---|---|---|
| 2,918,226 | 12/1959 | O'Brien . | |
| 3,328,990 | 7/1967 | Sieger et al. . | |
| 3,998,399 | 12/1976 | Held et al. | 242/65 |
| 4,005,830 | 2/1977 | Smith | 242/78.6 X |
| 4,343,440 | 8/1982 | Engl | 242/67.1 R |
| 4,380,164 | 4/1983 | Kuwano | 242/78.1 X |
| 4,546,930 | 10/1985 | Rohde et al. | 242/65 X |
| 4,736,605 | 4/1988 | Klöckner et al. | 242/78.1 X |

FOREIGN PATENT DOCUMENTS 53-149852 12/1978 Japan .

*Primary Examiner*—Stuart S. Levy
*Assistant Examiner*—Steven M. duBois
*Attorney, Agent, or Firm*—Wenderoth, Lind & Ponack

[57] ABSTRACT

A coiler has a plurality of frame units. Each frame unit includes a first frame having a free end portion facing to the periphery of a mandrel for coiling a band plate and a base end portion rotatably pivoted to a shaft parallel to the axis of the mandrel. A first drive unit moves the first frame. A second frame is rotatably pivoted at the free end portion of the first frame to a shaft parallel to the axis of the mandrel. A second drive unit moves the second frame. A pressing roller is rotatably supported by the second frame for assisting fastening of the band plate around the mandrel. A circular guide is provided on the second frame to face the mandrel.

1 Claim, 4 Drawing Sheets

COILER

This application is a continuation of now abandoned application, Ser. No. 07/243,561, filed as PCT JP86/00652 on Dec. 25, 1986, published as WO88/04966 on Jul. 14, 1988.

BACKGROUND OF THE INVENTION

This invention relates to a coiler of the type in which a band plate is pressed against a mandrel by rollers.

Such coiler is an apparatus for coiling a rolled band plate into the form of a coil to facilitate the transportation or shipment thereof to subsequent processes. Known types of coilers include: a unit roller type in which the band plate is pressed against a mandrel by unit rollers and guided by circular guides, a belt horn type in which a belt is disposed so that the band plate is laid along the periphery of a mandrel, a chain horn type in which a roller chain is used instead of a belt, and a gripper type in which the advance of the leading end of the band plate is temporarily stopped when it reaches a mandrel and such leading end is gripped by a gripper provided on the periphery of the mandrel.

The unit roller type coiler is further classified into two types: a roller independent movable type which has the function of individually opening/closing a plurality of unit rollers provided in one coiler, and a roller interlocking movable type in which a plurality of unit rollers are opened/closed by one actuator by means of a link mechanism or a slide mechanism.

FIG. 3 shows a conventional coiler in which a rolled band plate 1 is conveyed on a roller table 2 and pulled into the coiler by a pair of pinch rollers 3*a* and 3*b*. The band plate then is guided between a gate 4 and an apron 5 and between an over guide 6*a* and a throat guide 6*b*, and is pressed against the periphery of a mandrel 8 by a plurality of unit rollers 7. After the leading end of the band plate 1 reaches the mandrel 8, the band plate 1 is bent so as to lie along the periphery of the mandrel 8 by the mandrel 8 and the unit rollers 7, rotating at circumferential speeds faster than the incoming speed of the band plate 1, and by circular or arcuate guides 6*c* not rotating together with the mandrel 8. As a result, the band plate is progressively coiled around the mandrel 8 in plural layers.

Although each unit roller 7 is controlled such that its circumferential speed becomes identical with the advancing speed of the band plate 1 after the band plate 1 reaches the position of the unit roller 7 and is pressed against the mandrel 8, the circumferential speed of the mandrel 8 is kept faster than the advancing speed of the band plate 1 until the band plate 1 fastens integrally around the mandrel 8. The band plate 1 lying on the periphery of the mandrel 8, after being coiled a few turns in plural layers around the periphery of the mandrel 8 by being pressed against the mandrel 8 by means of the unit rollers 7, is fastened integrally around the mandrel 8. Generally, it is not necessary, after the band plate 1 has been fastened around the mandrel 8, that the unit rollers 7 press the band plate 1, and thus the unit rollers 7 are retracted to the outside of an allowable maximum coil 10 which the mandrel 8 can accommodate during a coiling operation.

In the coiler, to improve the capability of the band plate 1 to fasten around the mandrel 8 to thereby reduce scratches that otherwise would be formed in the surface of the band plate 1, it is important to decrease the number of turns created up to the moment the band plate 1 is fastened around the mandrel 8. Further, it is important to improve the ability of each unit roller 7 to move over a stepped portion of the coiled/piled band plate 1 corresponding to the leading end thereof without any shock to thereby reduce dents (top marks) that would be formed in the stepped portion and enhance the quality of the coiled product. Therefore, where the position of the unit roller 7 is subjected to control, it is necessary to increase the speed of instantaneous shift or the speed of response of the unit roller 7 in the radial direction of the mandrel 8, or where the position of the unit roller 7 is not subjected to control, it is necessary to decrease the reaction force of inertia of the unit roller 7 and of its support mechanism in the radial direction of the mandrel 8.

To improve the capability of the band plate 1 to fasten around the mandrel 8, it is necessary to make any play or sag between the first turn of the band plate 1 and the periphery of the mandrel 8 as small as possible. Further, to improve the response of the unit roller 7, the total weight of the unit roller 7 and its support frame must be decreased, the shift direction in opening/closing of the unit roller 7 must be made to accord closely with a direction normal of the peripheral surface of the mandrel 8, the distance of shift of the unit roller 7 resulting from an increase in diameter of the coiled band plate 1 must be decreased, and so on.

Conventional coilers of the roller independent movable type will now be described with reference to FIGS. 7 through 12. In these drawings, among a plurality of unit rollers 7 and of circular guides 6*c* provided in a coiler, only one unit roller for pressing the leading end of the incoming band plate 1 against the mandrel 8 and one circular guide for guiding the same at the beginning of a coiler operation as well as their support frames, are illustrated, with the other identical components of the coiler being omitted for simplification of illustration.

The coiler shown in FIG. 7 is featured in that a rotary bearing portion of the unit roller 7 is integral with the circular guide 6*c*, these components are secured to a main frame 9*a* which is in turn pivotably supported via a frame bearing 16 by a coiler housing 18, and these components are caused to open/close by means of a hydraulic cylinder 13 supported via a trunnion 14 by the coiler housing 18. This coiler is the most popular of the roller independent movable type.

To improve the response of the unit roller 7 of the coiler shown in FIG. 7, the coiler shown in FIG. 8 is featured in that the unit roller 7 is rigidly supported by a roller frame 9*b* of small mass, and a buffer spring 15 is interposed between the main frame 9*a* and the roller frame 9*b*. In this coiler, since the circular guide 6*c* is supported by the main frame 9*a*, there is the drawback that the shift distance of the roller frame 9*b* relative to the main frame 9*a* cannot be made large.

The coiler shown in FIG. 9 is featured in that an auxiliary circular guide 17 is secured to the roller frame 9*b*, and the respective engaging portions of the auxiliary circular guide 17 and the circular guide 6*c*, which interfere with each other when the auxiliary circular guide 17 shifts relative to the circular guide 6*c*, are shaped in the form of comb teeth to prevent interference. Hence this coiler can partly ease the inconvenience of the coiler shown in FIG. 8.

The coiler shown in FIG. 10 has improved response of the unit roller 7, because the support and shift motion of the unit roller 7 are achieved independent of the circular guide 6*c*.

The coiler shown in FIG. 11 is featured in that instead of the spring 15 used in the coiler of FIG. 8 or in addition thereto, a hydraulic cylinder 13' is employed to control the position of the unit roller 7 such that the unit roller 7 runs on the stepped portion of the coiled/piled band plate 1 corresponding to the leading end thereof without any shock.

The coiler shown in FIG. 12 is featured in that the main frame 9a is shifted by a link mechanism composed of two arms 11.

In the conventional coilers described above, both the response of the unit roller and the capability of the band plate to fasten around the mandrel cannot be improved appreciably in view of mechanical limitations. The reasons for such limitations now will be described in greater detail with reference to FIGS. 4 through 6.

In the coiler shown in FIG. 4, the frame bearing 16 serving as the center of rotation for the unit roller 7 or the circular guide 6c when they are to be shifted is located outside the allowable maximum coil 10, and even in the type shown in FIG. 9 in which the auxiliary circular guide 17 is provided so as to pivot inside the allowable maximum coil 10, the frame bearing 16 serving as the center of pivot of the circular guide 6c itself is located outside the allowable maximum coil 10. To improve the response of the unit roller 7 in the coiler shown in FIG. 4, the angle $\alpha$ between the shift direction of the unit roller 7 and the line connecting the axial center of the unit roller 7 with the axial center of the mandrel 8 must be made to approach zero. If so constructed since the unit roller 7 runs on the stepped/raised portion of the coiled band plate 1 whose height corresponds to the thickness t thereof, the distance of shift becomes small, or the shift distance of the unit roller 7 when it retracts becomes small in case the position of the unit roller 7 is subjected to control. Accordingly, the response of the unit roller 7 will be improved. Incidentally, the minimum value of the shift distance of the unit roller 7 is t when $\alpha=0$ (degree).

For achieve such purpose if the frame bearing 16 serving as the support point of pivot for both the circular guide 6c and the unit roller 7 is displaced leftward from the position shown in FIG. 4 in which it is located outside the allowable maximum coil 10, the relationship between the increasing thickness h of the coiled band plate 1 and the spacing $\epsilon$ left between the peripheral surface of the coiled band plate 1 and the distal end of the circular guide 6c located on the opposite side to the unit roller 7 becomes as illustrated in FIG. 5 by curves a, b and c. In the case of curve c, the mechanism does not achieve its intended function. Also, in a type like the coilers shown in FIGS. 8, 9 and 11 in which the roller frame 9b supporting the unit roller 7 is provided on the main frame 9a made integral with the circular guide 6c, the shiftable distance of the unit roller 7 relative to the main frame 9a in the radial direction of the mandrel 8 is small and the relationship between h and $\epsilon$ is identical with the foregoing. Thus, there is the drawback that the value of $\alpha$ cannot be made small.

In FIG. 6, referring to the spacing $\delta$ between the leading end of the band plate 1 and the peripheral surface of the mandrel 8 when the leading end of the band plate 1 has taken one turn around the mandrel 8, thereby coming to the piled state, and to the angle $\beta$ defined at the center of rotation of the mandrel 8 between the distal end of the throat guide 6b located on the side of the mandrel 8 and the center of rotation of the first unit roller 7, the smaller the angle $\beta$, the smaller is the value $\delta$ representing the dip of the band plate 1. That is, the dip of the first turn of the band plate 1 with respect to the mandrel 8 decreases as the value of $\delta$ decreases, and the capability of the band plate 1 to fasten around the mandrel 8 is improved correspondingly.

In the conventional coilers, however, the rotation center 16 of the frame had to be located outside the outer diameter of the maximum coil 10 without exception. Further, in order to avoid interference when the maximum coil is reached, the frame bearing 16 had to be located at a position where it could not interfere with an incoming line 19 (a line tangent with respect to both the bottom pinch roller 3b and the outer diameter of the maximum coil) of the band plate when the maximum coil is reached as shown in FIG. 3. Due to such positional limitations, the unit roller 7, when pivoting about its center of pivot 16, had to be moved or shifted while assuming a certain angle with respect to the line connecting the centers of the mandrel 8 and the unit roller 7. Therefore, when running on the stepped portion of the coiled band plate created because of the presence of the thickness thereof, the unit roller had to move considerably. This, therefore, resulted in degradation in the response of the unit roller 7.

Further, to decrease the angle $\beta$ in the conventional coiler, the unit roller 7 had to be located close to the throat guide 6b. However, the frame bearing 16 could not be displaced leftward in FIG. 4 for the foregoing reasons. As a result, the angle $\beta$ could not be made small.

SUMMARY OF THE INVENTION

It is the object of the present invention to solve the foregoing several problems of the conventional coilers, and thus to provide a coiler capable of remarkably improving the response of a unit roller and the capability of a band plate to be fastened around a mandrel.

A coiler according to the present invention has a plurality of frame units, each frame unit comprising a first frame having a free end portion facing the periphery of a mandrel for coiling a band plate and base end portion rotatably pivoted to a shaft parallel to the axis of the mandrel, a first drive unit for moving the first frame, a second frame rotatably pivoted at the free end portion of the first frame to a shaft parallel to the axis of the mandrel, a second drive unit coupled to the second frame and the first frame for moving the second frame relative to the first frame, a pressing roller rotatably supported by the second frame for assisting fastening of the band plate around the mandrel, and a circular or arcuate guide provided on the second frame so as to face the mandrel.

According to the present invention, the second frame rotatably supporting the pressing roller is pivoted to the free end portion of the first frame and each of these two frames is provided with a driving unit, such as a cylinder. Therefore, the location of the point of pivot of the second frame can be freely selected, so that both the angle $\alpha$ shown in FIG. 4 and the angle $\beta$ shown in FIG. 6 can be made small.

As described above, according to the coiler of the present invention, a frame member for supporting the unit roller is divided into two, i.e. the second frame rotatably supporting the pressing roller and the first frame pivotably supporting the second frame. Therefore, the limitations in arrangement of the conventional coilers are avoided. Thus, the capability of the band plate to fasten around the mandrel and the response of the pressing roller are remarkably improved.

The present invention will now be described with reference to a preferred embodiment shown in the accompanying drawings.

DETAILED DESCRIPTION OF THE INVENTION

Figure 1:
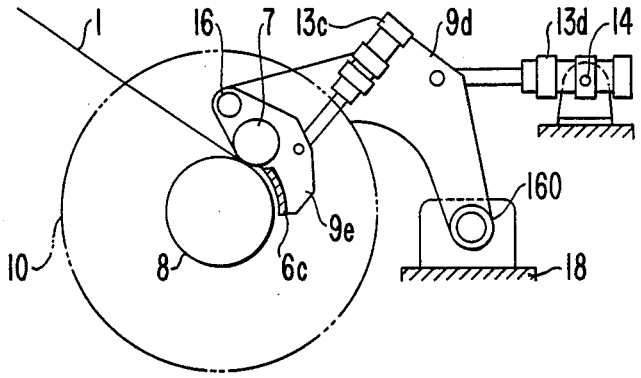
FIGS. 1 and 2 are functional schematic diagrams showing an embodiment of a coiler according to the present invention.
Figure 2:
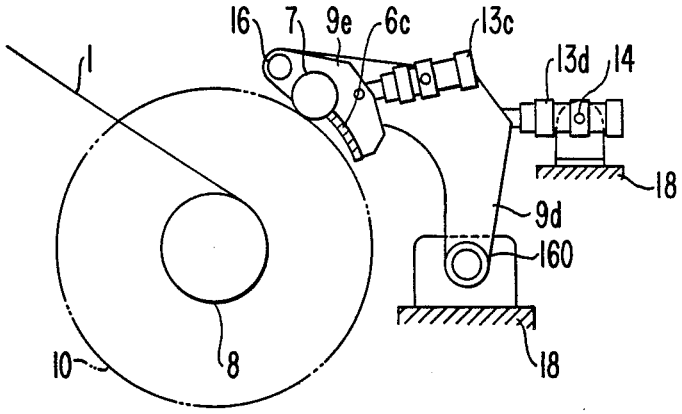
Figure 3:
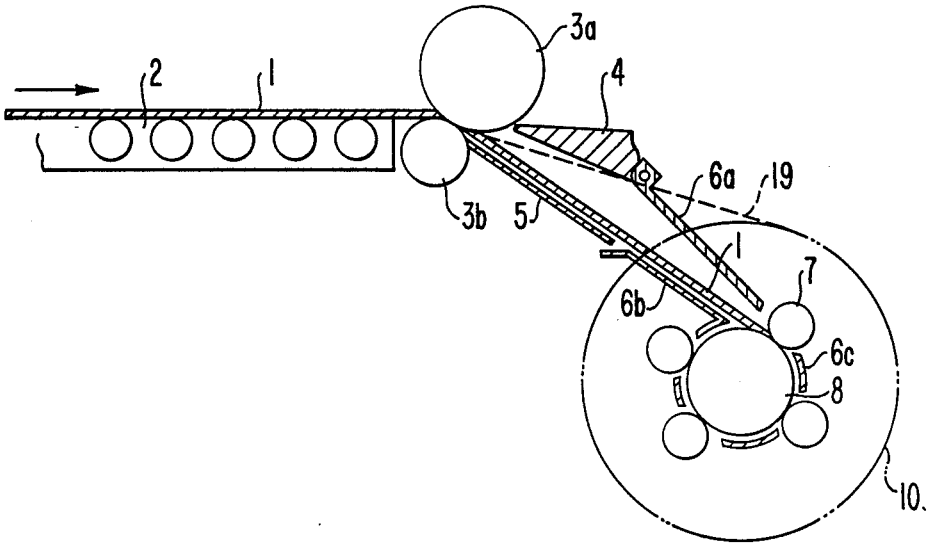
FIG. 3 (PRIOR ART)
FIG. 3 is a schematic diagram showing an example of a known coiler in a band plate rolling installation.

As shown in FIGS. 1 and 2 illustrating schematically the configuration of an embodiment of a coiler according to the present invention, a first frame **9*d* is provided with a frame bearing 16 serving as a center of rotation of a compact, second frame 9*e* which integrally supports a unit roller (a pressing roller) 7 and a circular guide 6*c*. A cylinder 13*c* causes pivotal motion of the second frame. The first frame 9*d* is pivoted by a cylinder 13*d*, which is supported by a trunnion 14, about a frame bearing 160 located outside an allowable maximum coil 10 of a band plate 1. Thus, the first frame 9*d* and the second frame 9*e* can independently perform open close motions. As will be appreciated from FIGS. 1 and 2, the first frame 9*d* and the second frame 9*e* can move or shift in opposite directions independently. As shown in FIGS. 1 and 2, when the first frame 9*d* is in the closed state, the frame bearing 16 serving as the center of rotation of the second frame 9*e* is located inside the allowable maximum coil 10, and it can be located at a position suitably upstream relative to the direction of feed of band plate 1**

Figure 4:
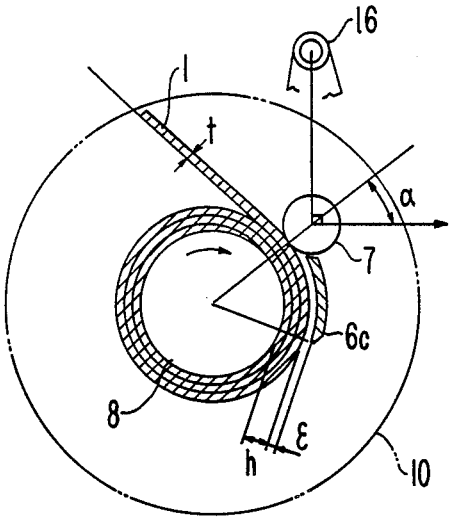
FIG. 4 is a schematic diagram showing a band plate being coiled around a mandrel.
Figure 5:
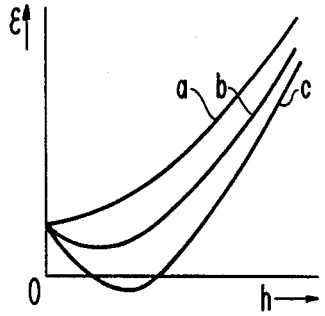
FIG. 5 is a graph illustrating the relationship between the thickness of the coiled band plate and the spacing left between the band plate and a circular guide.
Figure 6:
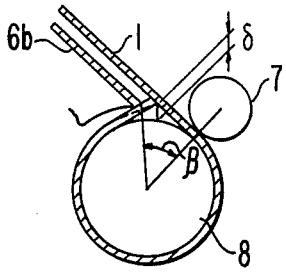
FIG. 6 is a schematic diagram showing a band plate whose leading end has taken one turn around the mandrel, thereby entering a layered state.
Figure 7:
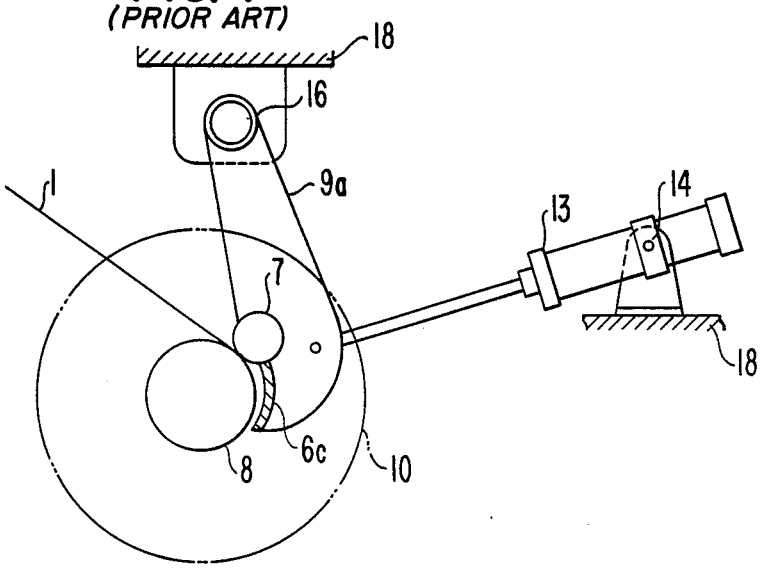
FIG. 7 (PRIOR ART)
FIGS. 7 through 12 are schematic diagrams showing conventional coilers.
Figure 8:
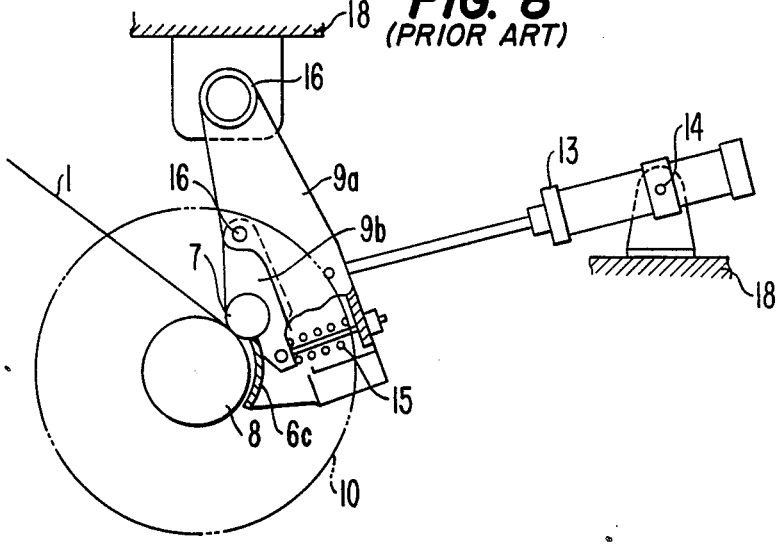
FIG. 8 (PRIOR ART)
Figure 9:
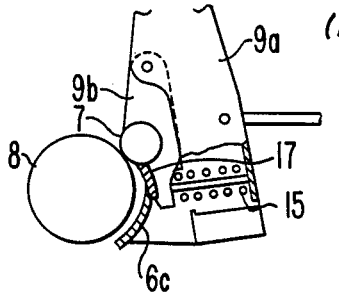
FIG. 9 (PRIOR ART)
Figure 10:
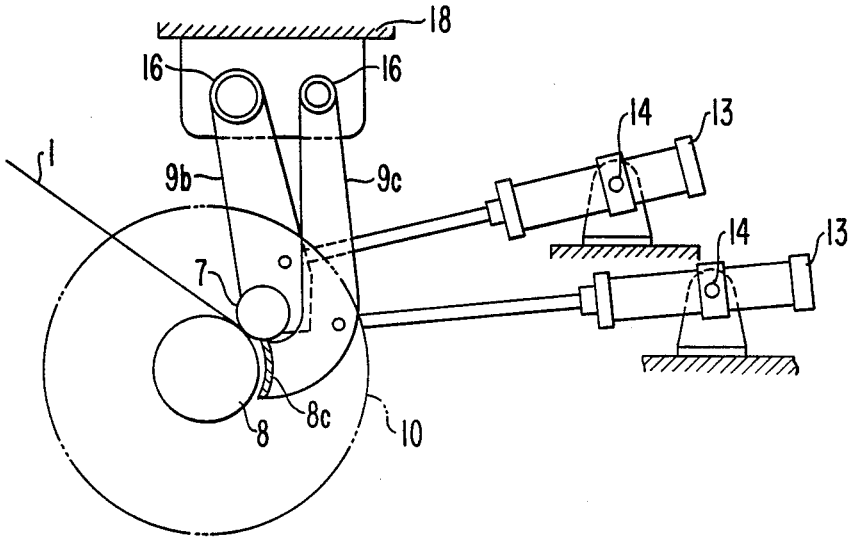
FIG. 10 (PRIOR ART)
Figure 11:
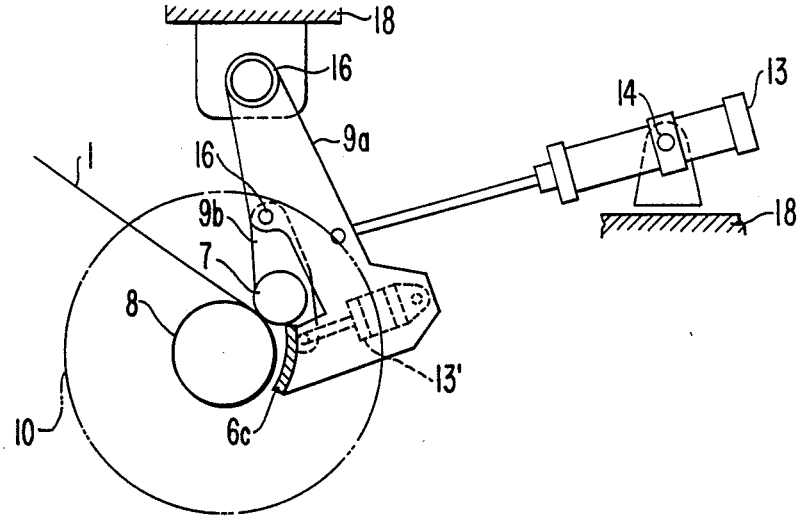
FIG. 11 (PRIOR ART)
Figure 12:
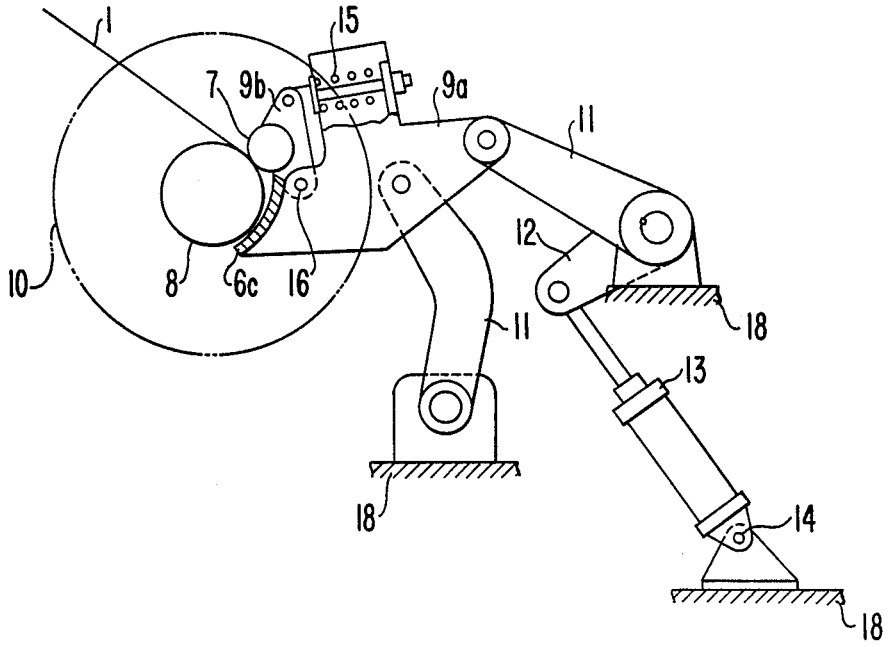
FIG. 12 (PRIOR ART)

In pressing the band plate 1 against a mandrel 8 by means of the unit roller 7 to start coiling, at the initial stage of coiling of the band plate 1 as shown in FIG. 4, the frame bearing 16 of the second frame **9*e* supporting both the unit roller 7 and the circular guide 6*c* is located inside the allowable maximum coil 10 so that it is located close to the mandrel 8 to enable decreasing its radius of rotation. As shown in FIGS. 1 and 2, by locating the frame bearing 16 sufficient upstream, the angle $\alpha$ shown in FIG. 4 and the angle $\beta$ shown in FIG. 6 can be made small. Therefore, all the problems of the conventional coilers described with reference to FIGS. 4 through 6** are solved.

As will be apparent from a consideration of FIGS. 1 and 2, the distance between the center of rotation of unit roller 7 and the axial center of shaft 16 is less than the maximum thickness of the layered coil 10 of the band plat to be coiled about mandrel 8.

What is claimed is:

1. In a coiler apparatus including a mandrel, and a plurality of frame units positioned around said mandrel and including rollers for coiling a band plate around said mandrel, the improvement wherein each said frame unit comprises:

a first frame member having a base end rotatably pivoted about a first shaft extending parallel to the axis of said mandrel and a free end;

first drive means for pivoting said first frame member about said first shaft such that said free end of said first frame member is moved toward or away from said mandrel;

a second frame member rotatably pivoted at said free end of said first frame member about a second shaft extending parallel to said axis of said mandrel;

second drive means coupled to said first and second frame members for pivoting said second frame member about said second shaft relative to said first frame member in directions toward or away from said mandrel;

an arcuate guide mounted on said second frame member for guiding and assisting in coiling of a band plate about said mandrel;

a unit roller rotatably supported by said second frame member for pressing the band plate against said mandrel, said unit roller being at a location adjacent said arcuate guide and between said first and second shafts;

a distance between the center of rotation of said unit roller and the axial center of said second shaft being less than the maximum thickness of a layered coil of the band plate to be coiled about said mandrel; and said first shaft being at a location positioned radially outwardly of the maximum outer circumference of the layered coil.

* * * * *